US012607381B2

(12) United States Patent
Yang et al.

(10) Patent No.: US 12,607,381 B2
(45) Date of Patent: Apr. 21, 2026

(54) NON-CONTACT INDOOR THERMAL ENVIRONMENT CONTROL SYSTEM AND METHOD BASED ON REINFORCEMENT LEARNING

(71) Applicants: Tianjin Chengjian University, Tianjin (CN); Xi'an University of Architecture and Technology, Xi 'an (CN)

(72) Inventors: Bin Yang, Tianjin (CN); Lingge Chen, Tianjin (CN); Xiaojing Li, Tianjin (CN); Bin Zhou, Tianjin (CN)

(73) Assignees: Tianjin Chengjian University, Tianjin (CN); Xi'an University of Architecture and Technology, Xi 'an (CN)

( * ) Notice: Subject to any disclaimer, the term of this patent is extended or adjusted under 35 U.S.C. 154(b) by 362 days.

(21) Appl. No.: 18/359,905

(22) Filed: Jul. 27, 2023

(65) Prior Publication Data

US 2024/0142130 A1 May 2, 2024

(30) Foreign Application Priority Data

Oct. 31, 2022 (CN) ..... 202211348680.7

(51) Int. Cl.
*F24F 11/65* (2018.01)
*F24F 110/10* (2018.01)
(Continued)

(52) U.S. Cl.
CPC ..... *F24F 11/65* (2018.01); *F24F 2110/10* (2018.01); *F24F 2110/20* (2018.01); *F24F 2120/20* (2018.01)

(58) Field of Classification Search
CPC .... F24F 2120/20; F24F 11/30; F24F 2110/10; F24F 2120/14; F24F 11/62; F24F 11/64;
(Continued)

(56) References Cited

U.S. PATENT DOCUMENTS 6,645,066 B2 * 11/2003 Gutta ..... F24F 11/74 454/229
6,970,576 B1 * 11/2005 Tilsley ..... G08B 13/19615 348/E7.086

(Continued)

*Primary Examiner* — Darrin D Dunn

(57) ABSTRACT

The invention provides a non-contact indoor thermal environment control system and a method based on reinforcement learning, which adopts a non-contact measurement mode to collect the video information of indoor personnel and judge the hot/cold state of the personnel through the processing of the video information. It can reduce the intrusiveness caused by the use of measuring equipment. At the same time, the invention adopts the reinforcement learning method to train and obtain the optimal thermal environment control strategy according to the environmental information, the hot and cold state of the personnel and the previous regulation strategy, which not only considers the difference of individual thermal comfort, but also satisfies the dynamic thermal comfort of personnel, improves the regulation efficiency of indoor thermal environment. At the same time, it can reduce the energy consumption of HVAC, achieve a sustainable state of energy saving and environmental protection.

7 Claims, 2 Drawing Sheets

(51) Int. Cl.
*F24F 110/20* (2018.01)
*F24F 120/20* (2018.01)

(58) Field of Classification Search
CPC ..... F24F 11/65; F24F 2120/10; G05B 15/02; G05B 2219/2642; G05B 19/042; G05B 2219/2614; G05B 13/0265; G05B 13/042; G05B 13/048; G06N 3/08; G06T 2207/30242; G06T 7/0002
See application file for complete search history.

(56) References Cited

U.S. PATENT DOCUMENTS

| | | | | |
|---|---|---|---|---|
| 10,360,304 | B1 * | 7/2019 | Alvarez | G05B 15/02 |
| 2015/0156031 | A1 * | 6/2015 | Fadell | G08B 27/003 700/90 |
| 2018/0299840 | A1 * | 10/2018 | Sinha | G05B 13/0265 |
| 2019/0338794 | A1 * | 11/2019 | Struhl | F16B 19/02 |
| 2019/0338974 | A1 * | 11/2019 | Turney | F24F 11/47 |
| 2020/0184329 | A1 * | 6/2020 | Gervais | F24F 11/62 |
| 2020/0191427 | A1 * | 6/2020 | Martin | F24F 11/57 |
| 2020/0194329 | A1 * | 6/2020 | Itoh | H01L 23/473 |
| 2021/0102722 | A1 * | 4/2021 | Nabi | F24F 11/46 |
| 2021/0131687 | A1 * | 5/2021 | Rucco | H04L 67/12 |
| 2021/0190361 | A1 * | 6/2021 | Chae | F24F 11/62 |
| 2022/0019186 | A1 * | 1/2022 | De Andrade | G06N 20/00 |
| 2022/0171356 | A1 * | 6/2022 | Yang | G05B 19/042 |
| 2022/0197319 | A1 * | 6/2022 | DeLuca | G05D 23/32 |
| 2024/0037778 | A1 * | 2/2024 | Rao | G06T 7/0002 |

* cited by examiner

NON-CONTACT INDOOR THERMAL ENVIRONMENT CONTROL SYSTEM AND METHOD BASED ON REINFORCEMENT LEARNING

TECHNICAL FIELD

The invention belongs to the field of building environment control, in particular to a non-contact indoor thermal environment control system and method based on reinforcement learning.

BACKGROUND

People spend most of their time indoors, and the indoor thermal environment can greatly affect people's physiology, psychology and work efficiency, so it is particularly important to create a comfortable indoor environment. The construction and control of indoor thermal environment is not only related to human health, thermal comfort, work and learning efficiency, but also has an important impact on building energy consumption. At present, about half of the building energy consumption is used for heating, ventilation and air-conditioning systems, and with the economic and social development, people have more stringent requirements on the indoor thermal environment, so HVAC consumes more energy. Therefore, scientific and reasonable regulation of indoor thermal environment has great significance to improve indoor personnel comfort and reduce building energy consumption.

The traditional indoor environment control mostly adopts a constant way. That is, the air-conditioning system is set to a constant temperature, but the research shows that under the condition of constant temperature, some people are still dissatisfied with the thermal environment. At the same time, if they are exposed to this constant thermal environment for a long time, they may be much more likely to suffer from sick building syndrome. This control method, which keeps the indoor environment constant within a certain range, ignores the dynamics of indoor thermal comfort, and does not take into account the individual differences and dynamic characteristics of thermal comfort state. At the same time, it also leads to unnecessary waste in energy supply.

In order to accurately grasp the thermal comfort state of indoor personnel in real time, contact measurement and semi-contact measurement are generally used to obtain physiological and environmental parameters. The traditional contact measurement mainly includes questionnaires and the use of various instruments to measure human skin temperature and metabolic rate, such as the use of mercury thermometer to measure human temperature. The traditional semi-contact measurement mainly refers to the integration of sensors into wearable devices, such as smart bracelets. These two measurement methods require frequent cooperation of personnel, which brings great inconvenience to people's life. At the same time, the use of various equipment to measure human physiological parameters is invasive, which will cause physical and psychological discomfort to indoor personnel.

The invention provides a non-contact indoor thermal environment control system and a method based on reinforcement learning, which adopts a non-contact measurement mode to collect the video information of indoor personnel and judge the hot/cold state of the personnel through the processing of the video information. It can reduce the intrusiveness caused by the use of measuring equipment. At the same time, the invention adopts the reinforcement learning method to train and obtain the optimal thermal environment control strategy according to the environmental information, the hot and cold state of the personnel and the previous regulation strategy, which not only considers the difference of individual thermal comfort, but also satisfies the dynamic thermal comfort of personnel, improves the regulation efficiency of indoor thermal environment. At the same time, it can reduce the energy consumption of HVAC, achieve a sustainable state of energy saving and environmental protection.

SUMMARY

Invent Content

In order to solve the problems with prior technology, the invention provides anon-contact indoor thermal environment control system and method based on reinforcement learning, which can improve the regulation efficiency of the indoor thermal environment and shorten the adjustment time. Enhance the comfort of indoor personnel, reduce the energy consumption of HVAC, and use the non-contact measurement method based on video processing to obtain relevant data to reduce the intrusiveness of detection equipment to users.

The invention is realized by the following technical scheme:

A non-contact indoor thermal environment control system based on reinforcement learning, which includes an information collection unit, an information processing unit, an environment prediction unit, a voice broadcasting unit and a terminal control unit.

The information collection unit is used for collecting indoor video information and environmental information in real time.

The information processing unit is used for obtaining the indoor condition and the hot/cold posture of the personnel according to the video information collected by the information collection unit, and judging the hot/cold state of the indoor personnel according to the hot/cold posture of the personnel.

The environment prediction unit is used for receiving the environmental information collected by the information collection unit and the hot/cold state of the indoor personnel output by the information processing unit. Combined with the historical regulation strategy of the thermal environment, the reinforcement learning method is used to train the regulation strategy in the current environment, and the optimal regulation strategy is obtained and output.

The voice broadcasting unit is used for receiving the regulation strategy output by the environment prediction unit, broadcasting the regulation strategy and receiving the reply instruction of the indoor personnel. If the reply instruction of the indoor personnel is affirmative, then the regulation strategy will continue to be output to the terminal control unit. If the response order of the indoor personnel is negative, the control strategy is returned to the environmental prediction unit, which retrains and outputs the new control strategy. If the indoor personnel do not reply to the instruction or irrelevant instructions within the set time, then continue to output the control strategy to the terminal control unit.

The terminal control unit is used to adjust the parameter setting of the air conditioner according to the receiving regulation strategy.

Preferred, the information collection unit comprises an image acquisition module and an environmental detection module.

The image acquisition module is used for collecting indoor video information.

The environmental detection module is used for collecting indoor environmental information, which includes temperature and humidity information.

Preferred, the environmental detection mode includes a temperature sensor and a humidity sensor.

Preferred, that the information processing unit comprises a target detection module, an attitude detection module and a state discrimination module.

The target detection module is used to detect the presence of personnel according to the video information collected by the information collection unit.

The attitude detection module is used to obtain the hot/cold posture of the indoor personnel according to the presence of the personnel detected by the target detection module and the video information collected by the information collection unit.

The state discrimination module is used to judge the hot/cold state of the indoor personnel according to the hot/cold posture of the indoor personnel obtained by the attitude detection module.

Further, the cold/hot posture of the indoor personnel includes: raising hands to wipe sweat, raising hands to fan, rolling up sleeves, folding arms, breathing to warm hands and holding hands to the neck. When the cold/hot posture of indoor personnel is to raise hands to wipe sweat, raise hands to fan or roll up sleeves, the cold/hot state of indoor personnel is felt hot. When the cold/hot posture of the indoor personnel is to fold arms, breathe to warm hands and hold hands to the neck, the cold/hot state of the indoor personnel is felt cold.

A non-contact indoor thermal environment control method based on reinforcement learning, which includes:

- S1, the information collection unit collects indoor video information and environmental information in real time.
- S2, the information processing unit judges the presence and hot/cold posture of the personnel according to the indoor video information, and judges the hot/cold state of the indoor personnel according to the hot/cold posture.
- S3, according to the indoor environmental information and the hot/cold state of the indoor personnel, combined with the historical regulation strategy of the thermal environment, the environment prediction unit adopts the method of reinforcement learning to train the regulation strategy in the current environment, and obtains the optimal regulation strategy.
- S4, the optimal regulation strategy obtained by voice broadcast, judge whether to adjust the air conditioning setting according to the indoor personnel's reply instruction, if the reply instruction is affirmative, then adjust the air conditioning setting according to the optimal regulation strategy. If the reply instruction is negative, return to S3. If the indoor personnel does not reply to instructions or irrelevant instructions within the set time, adjust the air conditioning settings according to the optimal control strategy.

Preferred, in S2, according to the collected video information, the YOLOv5 algorithm is used to judge the presence of personnel.

Preferred, in S2, according to the collected video information, the OpenPose algorithm is used to judge the hot/cold posture of the person.

Preferred, in S3, Q learning algorithm in reinforcement learning is used to train the regulation strategy in the current environment.

Compared with the prior technology, the invention has the following beneficial effects:

The invention is based on a non-contact indoor thermal environment control system based on reinforcement learning. It adopts a non-contact measurement mode, collects the video information of indoor personnel, and judges the hot/cold state of the personnel through the processing of the video information. It can reduce the use of some measuring equipment and cost, and effectively reduce the intrusiveness caused by the use of measuring equipment. Therefore, it can avoid causing physical and psychological discomfort to personnel. Also, it does not need frequent cooperation of personnel, which can save a lot of time, and will not affect the normal life and work of indoor personnel. So it has great convenience and intelligence. At the same time, the invention adopts the reinforcement learning method to train and obtain the optimal thermal environment control strategy according to the environmental information, the hot/cold state of the personnel and the previous regulation strategy, which not only fully considers the difference and time variation of individual thermal comfort, but also satisfies the dynamic thermal comfort of personnel, creates a flexible and sustainable thermal comfort environment for indoor personnel, and improves the regulation efficiency of indoor thermal environment. Keep the indoor thermal environment within the satisfactory range of personnel. At the same time, it can reduce the energy consumption of HVAC, improve energy efficiency, and achieve a green, healthy and sustainable state of energy saving and environmental protection.

Furthermore, Q learning is a reinforcement learning algorithm about state-action value function, which is mainly suitable for model-free control. It does not need to model the external environment in detail, but only needs to provide sufficient training samples. The optimal strategy is obtained through the interaction between the agent and the environment. Using Q learning algorithm to obtain the optimal regulation strategy of indoor thermal environment can not only improve the regulation efficiency of indoor thermal environment, shorten the regulation time, enhance the comfort of indoor personnel, but also reduce the energy consumption of HVAC.

DETAILED DESCRIPTION OF EMBODIMENTS

In order to further understand the invention, the invention is described below in conjunction with an embodiment, which is only a further explanation of the characteristics and advantages of the invention, but not used to limit the claims of the invention.

Figure 1:
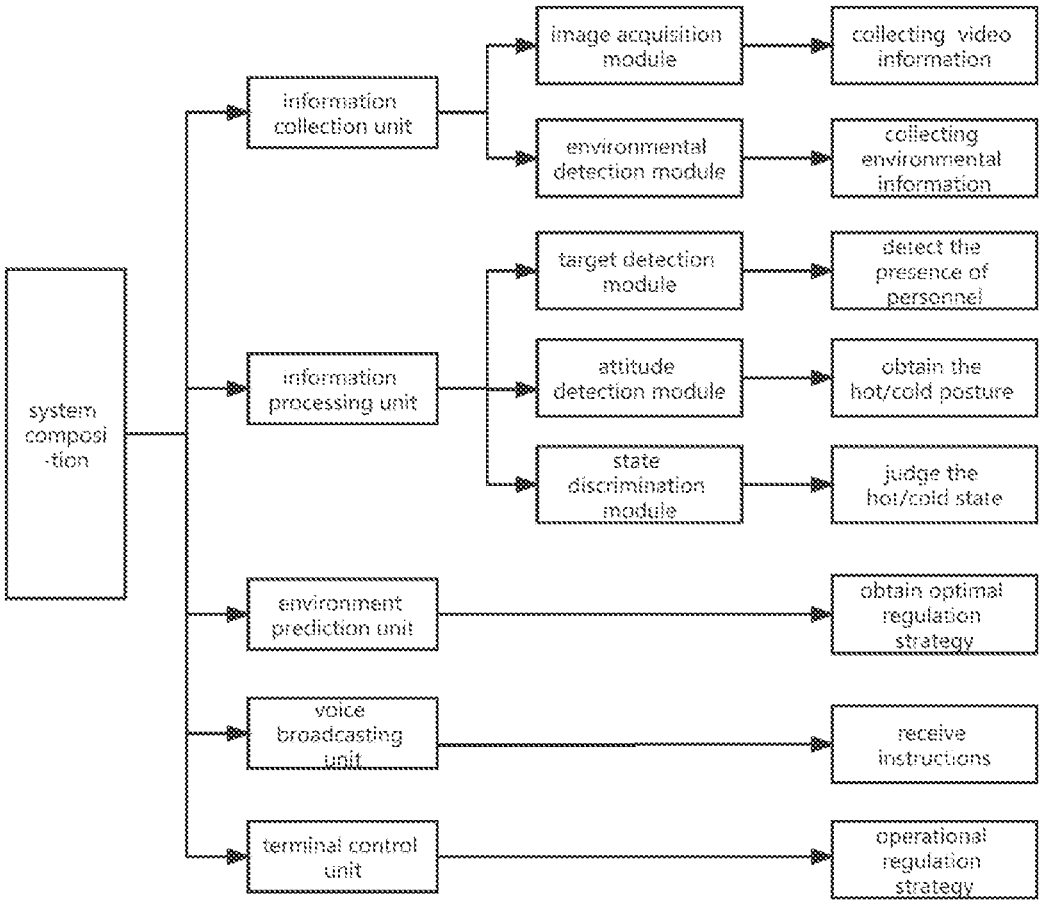
FIG. 1 Block diagram of a non-contact indoor thermal environment control system based on reinforcement learning.

As shown in FIG. 1, the invention relates to a non-contact indoor thermal environment control system based on reinforcement learning, which specifically comprises an information collection unit, an information processing unit, an environment prediction unit, a voice broadcasting unit and a terminal control unit.

The information collection unit is used for collecting indoor video information and environmental information in real time and provides data for the information processing unit. The information collection unit comprises an image acquisition module and an environmental detection module.

The image acquisition module is used for collecting indoor video information, mainly including a camera.

The environmental detection module is used for real-time detection of indoor environmental information, and the indoor environmental information of the invention is mainly concerned with indoor temperature and humidity information, so the environmental detection module mainly includes a temperature sensor and a humidity sensor.

The information processing unit is used for obtaining the indoor condition and the hot/cold posture of the personnel according to the video information collected by the information collection unit, and judging the hot/cold state of the indoor personnel according to the hot/cold posture of the personnel. The information processing unit comprises a target detection module, an attitude detection module and a state discrimination module.

The target detection module is used for detecting the condition of the personnel in the room according to the video information provided by the image acquisition module. When there are no people in the room, the environment prediction unit, voice broadcasting unit and terminal control unit are closed. When there are people in the room, the environment prediction unit, voice broadcasting unit and terminal control unit are all turned on automatically.

The attitude detection module is used to obtain the hot/cold posture of the indoor personnel according to the presence of the personnel detected by the target detection module and the video information collected by the information collection unit. The hot/cold posture concerned by the invention are as follows: raising hands to wipe sweat, raising hands to fan, rolling up sleeves, folding arms, breathing to warm hands and holding hands to the neck. The above hot/cold posture indicates that the indoor personnel are in an uncomfortable state and have the idea of changing the indoor thermal environment.

The state discrimination module is used to judge the hot/cold state of the indoor personnel according to the hot/cold posture of the indoor personnel obtained by the attitude detection module. The hot/cold states of the indoor personnel include: the indoor personnel feel hot and the indoor personnel feel cold. Among the above hot/cold posture, the typical ones that feel hot are raising hands to wipe sweat, raising hands to fan, rolling up sleeves. Raising hands to wipe sweat means that the thermal environment at this time is higher than the normal thermal comfort state of the human body, and people have obvious thermal sensation, accompanied by significant characteristics of sweating, so raising hands to wipe sweat can represent the phenomenon of thermal discomfort at the moment. Raising hands to fan indicates that the person feels hot and unbearable, wants to increase the wind speed and reduce the heat sensation through the fan. Rolling up sleeves means that the clothes you are wearing at this time affect the heat dissipation, and you need to expose your arms to increase the heat dissipation, which is also a state of thermal discomfort. The typical posture of feeling cold are folding arms, breathing to warm hands and holding hands to the neck. Folding arms means that the thermal environment at this time is much lower than the body surface temperature, resulting in a decrease in body surface temperature, while the human body needs to preserve heat and reduce heat loss, so holding arms is a typical feature of people feeling cold. Breathing to warm hands means that the skin temperature of the hands is extremely low and the human body feels cold. Breathing can alleviate the cold degree of the hands to a certain extent. Holding hands to the neck shows that the skin temperature of the hand is much lower than that of the rest, which makes people feel cold. putting the hand near the neck with higher surface temperature can also relieve the cold of the hand. Therefore, in the above hot/cold postures, raising hands to wipe sweat, raising hands to fan, rolling up sleeves. are defined as indoor personnel feeling hot. Folding arms, breathing to warm hands and holding hands to the neck are considered to be indoor personnel feeling cold. Except for the above six human body posture, the rest of the human body posture are considered invalid and cannot trigger the follow-up operation.

The environment prediction unit is used for receiving the environmental information collected by the information collection unit and the hot/cold state of the indoor personnel output by the information processing unit. Combined with the historical regulation strategy of the thermal environment, the reinforcement learning method is used to train the regulation strategy in the current environment, and the optimal regulation strategy is obtained and output. So as to meet the thermal comfort requirements of indoor personnel. The control strategy concerned by the invention mainly includes the temperature and wind speed of the air conditioner.

The voice broadcasting unit is used for receiving the regulation strategy output by the environment prediction unit, broadcasting the regulation strategy and receiving the reply instruction of the indoor personnel. If the reply instruction of the indoor personnel is affirmative, for example, "yes", "good", etc, then the regulation strategy will continue to be output to the terminal control unit. If the response order of the indoor personnel is negative, such as "no" or "error", etc, the control strategy is returned to the environmental prediction unit, which retrains and outputs the new control strategy. If the indoor personnel do not reply to the instruction or irrelevant instructions within the set time, then continue to output the control strategy to the terminal control unit. The voice broadcasting unit mainly includes sound.

The terminal control unit is used to adjust the temperature and wind speed of the air conditioner according to the control strategy of the output, so as to create a satisfactory indoor thermal environment.

In a specific embodiment, the camera is installed in the upper part of the room, and the best shooting distance is 0.8-3.5 meters from the indoor personnel, and it is appropriate that the camera can clearly capture the scene of the upper body of the person.

In a specific embodiment, the temperature sensor and the humidity sensor are installed on the wall of the room, close to the air outlet of the air conditioner, without affecting life and indoor beauty.

In a specific embodiment, the target detection module mainly uses the YOLOv5 algorithm to judge the presence of personnel according to the indoor images captured by the camera.

In a specific example, the attitude detection module mainly uses the OpenPose algorithm to detect the key nodes of the face, hands and various parts of the body according to the indoor real-time video information obtained by the camera, and to distinguish different hot/cold according to the continuous motion trajectories of the nodes. The invention pays attention to the macroscopic movement posture of the human body and adopts 18 key nodes for detecting the human body.

In a specific example, the environmental prediction unit mainly uses the Q learning algorithm in reinforcement learning to train the optimal regulation strategy according to the indoor temperature and humidity and the hot and cold state of the human body at that time, combined with the historical regulation strategy of the thermal environment. The state variables are the current indoor temperature and humidity information and the hot and cold state of the human body, and the action variables are the supply air temperature and speed of indoor air conditioning.

In a specific example, the audio equipment is installed on the indoor wall, so that the indoor personnel can hear the broadcast voice message clearly and accurately without affecting the work of the personnel.

In a specific example, the voice broadcasting unit uses the semantic recognition algorithm to identify the relevant instructions replied by the personnel, and selects to continue to output the regulation strategy or return the regulation strategy to the environment prediction unit according to the relevant instructions.

In a specific example, the voice broadcasting unit uses the semantic recognition algorithm to identify the relevant instructions replied by the personnel, and selects to continue to output the regulation strategy or return the regulation strategy to the environment prediction unit according to the relevant instructions.

Figure 2:
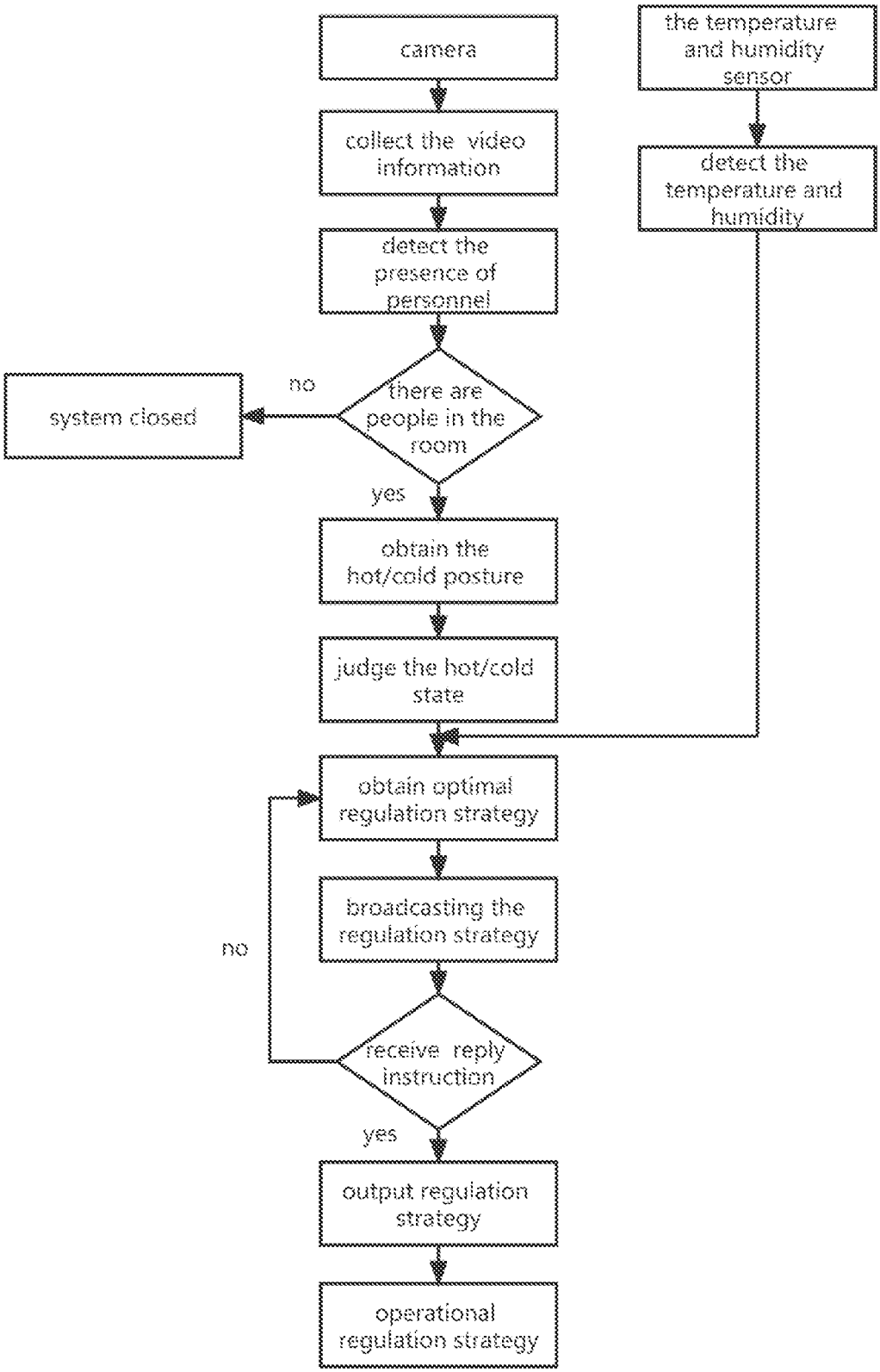
FIG. 2 Flow chart of a contactless indoor thermal environment control method based on reinforcement learning.

As shown in FIG. 2, the invention relates to a non-contact indoor thermal environment control method based on reinforcement learning, which is based on the system and comprises the following steps:

S1, collect indoor video information and indoor environment information in real time, and indoor environment information is indoor temperature and humidity information.

S2, according to the collected video information, obtain the presence of the personnel in the room and their hot/cold posture, and judge the hot/cold state of the indoor personnel according to the hot and cold posture.

S3, according to the indoor temperature and humidity information and the cold/hot state of indoor personnel, combined with the historical regulation strategy of the thermal environment, the reinforcement learning method is used to train the regulation strategy in the current environment, so as to obtain the optimal regulation strategy.

S4, voice broadcast the optimal control strategy, and judge whether to adjust the air conditioning setting according to the indoor staffs reply instruction. If the indoor staffs reply instruction is positive, then adjust the air conditioning setting according to the optimal control strategy. If the indoor staffs reply instruction is negative, return to S3. If the indoor staff does not reply to instructions or irrelevant instructions within the set time, adjust the air conditioning settings according to the optimal control strategy.

Example

As shown in FIG. 1, the invention provides a non-contact indoor thermal environment control system based on reinforcement learning, which comprises an information collection unit, an information processing unit, an environment prediction unit, a voice broadcasting unit and a terminal control unit.

The information collection unit uses the camera installed in the upper part of the room to collect the real-time video information of the room, and uses the temperature sensor and humidity sensor installed on the room wall to detect the temperature and humidity of the indoor air in real time. Then the video information and indoor temperature and humidity information are transmitted to the information processing unit.

According to the real-time video information collected by the information collection unit, the information processing unit acquires the presence of the personnel in the room and their hot/cold posture, and judges the hot/cold state of the indoor personnel according to the hot/cold posture. Among them, the target detection module adopts YOLOv5 algorithm to judge whether there are people in the room according to the indoor video information collected by the camera. When there are no people in the room, the environment prediction unit, voice broadcasting unit and terminal control unit are closed. When there are people in the room, the environment prediction unit, voice broadcasting unit and terminal control unit are all turned on automatically. The attitude detection module uses the OpenPose algorithm to detect 18 key nodes in all parts of the human body according to the indoor real-time video captured by the camera, and to distinguish different hot/cold posture according to the continuous motion trajectories of the key nodes. Among them, according to the macroscopic movement posture of the human body, the main posture that indicate the hot and cold state of the human body are raising hands to wipe sweat, raising hands to fan, rolling up sleeves. Folding arms, breathing to warm hands and holding hands to the neck The state discrimination module judges the hot/cold state of the indoor personnel according to the hot/cold posture detected by the attitude detection module. Among the six hot/cold posture, the typical ones that feel hot are raising hands to wipe sweat, raising hands to fan, rolling up sleeves. Raising hands to wipe sweat means that the thermal environment at this time is higher than the normal thermal comfort state of the human body, and people have obvious thermal sensation, accompanied by significant characteristics of sweating, so raising hands to wipe sweat can represent the phenomenon of thermal discomfort at the moment. Raising hands to fan indicates that the person feels hot and unbearable, wants to increase the wind speed and reduce the heat sensation through the fan. Rolling up sleeves means that the clothes you are wearing at this time affect the heat dissipation, and you need to expose your arms to increase the heat dissipation, which is also a state of thermal discomfort. The typical posture of feeling cold are folding arms, breathing to warm hands and holding hands to the neck. Folding arms means that the thermal environment at this time is much lower than the body surface temperature, resulting in a decrease in body surface temperature, while the human body needs to preserve heat and reduce heat loss, so holding arms is a typical feature of people feeling cold. Breathing to warm hands means that the skin temperature of the hands is extremely low and the human body feels cold. Breathing can alleviate the cold degree of the hands to a certain extent. Holding hands to the neck shows that the skin temperature of the hand is much lower than that of the rest, which makes people feel cold. putting the hand near the neck with higher surface temperature can also relieve the cold of the hand. Therefore, in the above hot/cold postures, raising hands to wipe sweat, raising hands to fan, rolling up sleeves are defined as indoor personnel feeling hot. Folding arms, breathing to warm hands and holding hands to the neck are considered to be indoor personnel feeling cold. Except for the above six human body posture, the rest of the human body posture are considered invalid and cannot trigger the follow-up operation.

After receiving the real-time temperature and humidity information detected by the information collection unit and the cold/hot state of the indoor personnel output by the information processing unit, the environmental prediction unit adopts the Q learning algorithm in reinforcement learning, combined with the historical control strategy of the thermal environment, train the regulation strategy in the current environment, so as to obtain the optimal regulation strategy in the current environment, so as to adapt to the dynamic thermal comfort of indoor personnel. Ensure that the indoor environment is always within the range of personnel satisfaction. At the same time, the regulation strategy is output to the voice broadcasting unit.

After receiving the control strategy, the voice broadcasting unit uses the sound installed on the indoor wall to broadcast the instruction and receives the reply from the indoor staff. If the reply instruction of the indoor personnel is affirmative, for example, "yes", "good", etc, then the regulation strategy will continue to be output to the terminal control unit. If the response order of the indoor personnel is negative, such as "no" or "error", etc, the control strategy is returned to the environmental prediction unit, which retrains and outputs the new control strategy. If the indoor personnel do not reply to the instruction or irrelevant instructions within 3 minutes, then continue to output the control strategy to the terminal control unit. The voice broadcasting unit mainly includes sound.

According to the received control strategy, the terminal control unit adjusts the temperature and wind speed of the air conditioner accordingly, so as to create a satisfactory thermal environment for indoor personnel.

What is claimed is:

1. A non-contact indoor thermal environment control system based on reinforcement learning, comprising an information collection unit, an information processing unit, an environment prediction unit, a voice broadcasting unit and a terminal control unit;

wherein the information collection unit is used to collect indoor video information and indoor environmental information in real time; and the information collection unit comprises:

an image acquisition module, comprising a camera, wherein the camera is used to collect the indoor video information; and an environmental detection module, comprising a temperature sensor and a humidity sensor, wherein the temperature sensor and the humidity sensor are used to collect the indoor environmental information, which includes temperature and humidity information;

wherein the information processing unit, comprises a first processor, wherein the first processor is used to: obtain an indoor condition and a hot/cold posture of indoor personnel according to the indoor video information collected by the camera, and judge a hot/cold state of the indoor personnel according to the hot/cold posture of the indoor personnel;

wherein the environment prediction unit, comprises a second processor, wherein the second processor is used to receive the indoor environmental information collected by the temperature sensor and the humidity sensor and the hot/cold state of the indoor personnel output by the first processor, and train a regulation strategy in a current environment by combining with a historical regulation strategy of a thermal environment and using a Q learning algorithm to obtain an optimal regulation strategy and output the optimal regulation strategy to the voice broadcasting unit; and wherein the voice broadcasting unit comprises a sound, and the terminal control unit comprises a controller; and the sound is used to: receive the optimal regulation strategy output by the second processor, and broadcast the optimal regulation strategy and receive a reply instruction of the indoor personnel; in response to the reply instruction of the indoor personnel being affirmative, output the optimal regulation strategy to the controller; in response to the reply instruction of the indoor personnel being negative, return the optimal regulation strategy to the second processor for retraining and updating the optimal regulation strategy; and in response to no reply instruction being received within a set time, output the optimal regulation strategy to the controller; and the controller is used to control an environmental temperature by adjusting an output level of an air conditioner responsive to implementing the optimal regulation strategy.

2. The non-contact indoor thermal environment control system based on reinforcement learning according to claim 1, wherein the first processor is further configured to:

detect a presence of personnel according to the indoor video information collected by the camera;

obtain the hot/cold posture of the indoor personnel according to the presence of personnel and the indoor video information collected by the camera; and judge the hot/cold state of the indoor personnel according to the hot/cold posture of the indoor personnel.

3. The non-contact indoor thermal environment control system based on reinforcement learning according to claim 1, wherein the hot/cold posture of the indoor personnel includes: raising hands to wipe sweat, raising hands to fan, rolling up sleeves, folding arms, breathing to warm hands and holding hands to neck; when the hot/cold posture of the indoor personnel is to raise hands to wipe sweat, raise hands to fan or roll up sleeves, the hot/cold state of the indoor personnel is felt hot; and when the hot/cold posture of the indoor personnel is to fold arms, breathe to warm hands and hold hands to the neck, the hot/cold state of the indoor personnel is felt cold.

4. The non-contact indoor thermal environment control system based on reinforcement learning according to claim 2, wherein the first processor is further used to detect the presence of personnel by using a you only look once version 5 (YOLOv5) algorithm.

5. The non-contact indoor thermal environment control system based on reinforcement learning according to claim 2, wherein the first processor is further used to judge the hot/cold posture of the indoor personnel by using an OpenPose algorithm.

6. The non-contact indoor thermal environment control system based on reinforcement learning according to claim 1, wherein the optimal regulation strategy comprises a temperature and a wind speed of the air conditioner.

7. A non-contact indoor thermal environment control method based on reinforcement learning implemented by the non-contact indoor thermal environment control system based on reinforcement learning according to claim 1, comprising:

S1, collecting, by the camera, the indoor video information, and collecting, by the temperature sensor and the humidity sensor, the indoor environmental information in real time;

S2, obtaining the indoor condition and the hot/cold posture of the indoor personnel according to the indoor video information, and judging the hot/cold state of the indoor personnel according to the hot/cold posture of the indoor personnel;

S3, training the regulation strategy in the current environment according to the indoor environmental information and the hot/cold state of the indoor personnel, and by combining with the historical regulation strategy of the thermal environment and using the Q learning algorithm to obtain the optimal regulation strategy and output the optimal regulation strategy to the sound;

S4, broadcasting, by the sound, the optimal regulation strategy, and judging, by the sound, whether to adjust an air conditioning setting according to the reply instruction of the indoor personnel; wherein the judging, by the sound, whether to adjust an air conditioning setting according to the reply instruction of the indoor personnel comprises:

in response to the reply instruction of the indoor personnel being affirmative, controlling the environmental temperature by adjusting the output level of the air conditioner responsive to implementing the optimal regulation strategy;

in response to the reply instruction of the indoor personnel being negative, returning the optimal regulation strategy to the second processor for retraining and updating the optimal regulation strategy; and in response to no relay instruction being received within a set time, controlling the environmental temperature by adjusting the output level of the air conditioner responsive to implementing the optimal regulation strategy.

* * * * *